United States Patent [19]

zu Köcker et al.

[11] 4,224,136

[45] Sep. 23, 1980

[54] PROCESS FOR THE SOLVENT EXTRACTION OF SOLID CARBON-CONTAINING MATERIALS, PRINCIPALLY COAL

[75] Inventors: Heinz M. zu Köcker; Jürgen Tietze, both of Berlin, Fed. Rep. of Germany

[73] Assignee: Bergwerksverband GmbH, Essen, Fed. Rep. of Germany

[21] Appl. No.: 958,483

[22] Filed: Nov. 7, 1978

[30] Foreign Application Priority Data

Nov. 8, 1977 [DE] Fed. Rep. of Germany ..... 2749809

[51] Int. Cl.[2] ..... C10G 1/04

[52] U.S. Cl. ..... 208/8 LE; 196/14.52; 208/157

[58] Field of Search ..... 208/8 LE, 157; 196/14.52

[56] References Cited

U.S. PATENT DOCUMENTS

| | | | |
|---|---|---|---|
| 3,660,267 | 5/1972 | Rieve et al. | 208/8 LE |
| 4,039,425 | 8/1977 | Neavel | 208/8 LE |
| 4,090,957 | 5/1978 | Leonard | 208/8 LE |
| 4,125,452 | 11/1978 | Effron | 208/8 LE |

*Primary Examiner*—Herbert Levine

*Attorney, Agent, or Firm*—Michael J. Striker

[57] ABSTRACT

A solid carbonaceous material principally coal is subjected to a solvent extraction by

[a] introducing a hydrogen donor-solvent and the carbonaceous particulate material into a generally vertically directed extraction zone at an elevated pressure;

[b] imparting a continuous generally upwards directed flow to said solvent, the solvent being at a temperature above the softening temperature of the said particles and the pressure being higher than the vapor pressure of the solvent at said temperature, the flow velocity of the solvent being sufficient to cause fluidization of said particles;

[c] withdrawing the solvent together with the formed extract continuously at the top of the extraction zone while preventing the entrainment of solid particles;

[d] effecting the separation of the extract and solvent outside said extraction zone;

[e] removing the remaining solid particles together with residual extract-free or extract-lean solvent from the extraction zone separate from the withdrawal at [c]; and

[f] separating the solvent removed at [e] from the solid particles.

13 Claims, 3 Drawing Figures

PROCESS FOR THE SOLVENT EXTRACTION OF SOLID CARBON-CONTAINING MATERIALS, PRINCIPALLY COAL

BACKGROUND OF THE INVENTION

The invention relates to a process for the solvent extraction of solid carbon-containing materials, principally coal at elevated temperatures and at pressures which are above the vapor pressure of the solvent at the temperature employed. Specifically, the process relates to such processes which are carried out without catalysts. The invention also includes an apparatus for carrying out the process.

In this kind of process one tries to obtain from the unrefined raw material as high a percentage as possible of the desired useful components. The extraction of only a certain part of the raw material can also be of interest for the improvement of its technological properties for use in further refining processes. The extraction or part extraction involves also the problem of the removal of the undissolved residual solids from the solvent-extract mixture. The technological and economical usefulness of a particular process accordingly is determined by the combination of these two steps, that is extraction and elimination or removal of the extracted solids. A special object is in general to carry out the extraction in a continuous process which would result in substantial economical advantages.

From the German Pat. No. 663,497 it is known that coal extracts can be obtained from all kinds of coal by carrying out the extraction in a stage slightly above the decomposition stage of the insoluble residual coal which forms eventually in the step-by-step extraction at increasing temperatures (German Pat. No. 632,631). In an example of the first-mentioned patent a dried long-flame gas coal is extracted in 165 minutes at up to 63%. It is, however, noted there that by substantially departing from the stated temperature, either upwards or downwards, the extract yield is reduced.

If higher extract yields are to be obtained, it is necessary according to the just-mentioned German Pat. No. 612,631, to effect the extraction at temperatures below the decomposition temperature of the coal used as starting materials or any remaining residual material. In this process the temperature is increased step-by-step and the residual coal is separated from the solvent after each stage. Thus, each stage may have its own process cycle.

A shortcoming of these processes is, apart from the economically usually still unsatisfactory degree of decomposition, the large amount of time of at least 150 minutes which is necessary for such extraction and it is furthermore necessary in these processes to effect the separation of the residual solids from the solvent-extract mixture affer completion of the extraction. The latter step has been found to be exceedingly difficult, particularly in case of highly viscous extract components. These problems of the extraction process are also mentioned in the published German applications Nos. 2,522,772 and 2,522,746.

It is therefore an object of the present invention to make possible the complete decomposition of the solid carbonaceous material, and this without addition of a catalyst, only by means of conventional solvents. The process is to be carried out in a continuous or semicontinuous operation and without external separation problems between the residual coal and the extract-charged solvent. Besides, the time necessary for the total process is to be substantially reduced compared with the prior art processes. In addition the invention has the object of permitting a quick pretreatment of solid carbon-containing materials in order to modify their technological properties.

SUMMARY OF THE INVENTION

This object is solved by a process comprising

[a] introducing a hydrogen donor-solvent and the carbonaceous particulate material into a generally vertically directed extraction zone at an elevated pressure;

[b] imparting a continuous generally upwards directed flow to said solvent, the solvent being at a temperature above the softening temperature of the said particles and the pressure being higher than the vapor pressure of the solvent at said temperature, the flow velocity of the solvent being sufficient to cause fluidization of said particles;

[c] withdrawing the solvent together with the formed extract continuously at the top of the extraction zone while preventing the entrainment of solid particles;

[d] effecting the separation of the extract and solvent outside said extraction zone;

[e] removing the remaining solid particles together with residual extract-free or extract-lean solvent from the extraction zone separate from the withdrawl at [c]; and

[f] separating the solvent removed at [e] from the solid particles.

The solvent separated at [d] may be recycled.

The process may be carried out preferably in a continuous operation in apparatus described below.

The conversion of the prior art autoclave extraction of solid carbon-containing materials to a continuous or semi-continuous operation has been found to be exceedingly difficult since at the necessary temperatures the reaction vessels repeatedly get clogged up, the extract yield is small and therefore uneconomical and the separation of the solid particles from the extract is not adequate.

By use of the fluidizing technique in the present invention it has been made possible to extract solid carbon-containing materials, particularly all kinds of coal, in continuous or semi-continuous operation in a complete manner and in a relatively short time, and at the same time to almost completely avoid the problem of the separation of solids from the extract.

In the literature there is little discussion of two or three-phase fluidizing beds (solid, liquid and solid, liquid, gaseous) in which reactions take place which are subject to continuous changes because of the properties of the fluidized material (grain size, material composition, density, etc.) and because of the fluidizing medium (density, viscosity, etc.). It was therefore necessary to carry out extensive experiments to obtain any certainty of results.

In these experiments it was found surprisingly that the degree of disintegration is almost independent of the grain size of the treated carbon-containing materials as long as the extraction temperature is above the softening temperature of the particular carbon-containing material. The required fluidizing bed conditions, however, can be realized only in a mean grain size range between 0.1 and 10 mm, in particular between 1 and 8 mm. Normally, it is preferable to use a grain size of at most 3 mm.

It was furthermore found that the degree of disintegration is so much greater as the extraction temperature is above the softening temperature of the carbon-containing material. The softening temperatures of most carbon-containing materials, particularly of all types of coal, are between about 550° and 750° K. (about 280° to 480° C.). The extraction temperatures to be used accordingly are between about 650° and 850° K. (about 380° to 580° C.). Their upper limit is determined by the critical temperature of the solvent, which for instance in case of tetralin is about 470° C. These temperatures do not constitute any problem when employed as part of the fluidizing bed approach.

In the above, reference was made to the degree of disintegration. This refers to the quotient between (a) the difference between the masses of the employed solids and the insoluble residues and (b) the mass of the water- and ash-free carbon-containing material times 100. In the process of the invention disintegration degrees can be obtained above 90%. The disintegration degree in the last analysis is determined by the contents, in the carbon-containing material, of minerals and the inertinite which is difficult to dissolve or almost insoluble. Related to a water-, mineral- and inertinite-free carbon-containing material a 100% extraction can practically in all cases be obtained by the process of the invention and does not present any specific problems.

In the process of the invention it is in principle possible to use all solvents provided they are hydrogen donors which have become known in the coal extraction art. Among these are particularly tetralin which through loss of hydrogen is converted to naphthalene. However, it is also possible to use part of the recovered extract by simply adding it to the solvent or to use inexpensive hydrogenation oils.

The formation of the required suspension between carbon-containing material and solvent prior to introduction into the extraction reactor and particularly preheating of the suspension will result in a shortening of the extraction time. Surprisingly, this preheating is of advantage only on condition that it does not result itself in any substantial extraction and does not cause any swelling of the carbon-containing material. Otherwise clogging up of the feed lines would occur. It has been found that the preheating of the suspension should not be higher than up to about 300° C.

The suspension is diluted in the extraction reactor by a separately introduced hot current of solvent. This current must be adjusted according to criteria well known in fluidizing bed technique so that the solid carbon-containing particles are caused to be in a fluidizing condition. However, the fluidizing movement must not be violent to the extent that solid particles are entrained at the place where the main portion of the solvent-extract mixture is withdrawn. As a matter of precaution it is therefore advisable additionally to provide for a device for holding back the solid particles at the place of withdrawal. A speed as low as possible of the separately introduced current of solvent is advisable also for the reason that the costs are kept low through a low solvent throughput. This also implies that the suspension should contain as little solvent as possible.

The pressure of the extraction as brought out in the claim must not be below the vapor pressure of the solvent at the extraction temperature. It may be between 25 and 60 bar as conventional in prior art extraction processes.

By means of the fluid bed technique it is possible to carry out the extraction at the comparatively high temperatures above specified without causing the extract to clog up the reactor. Because of the improved material movement it is also possible to operate at shorter reaction times than was possible in prior art autoclave extractions. Through the continuous withdrawal of the extract by means of the solvent current, it is possible to dispense with the difficult separation of solids from the extract after the extraction.

The removal of the extract-free or extract-lean solvent from any remaining solids after withdrawal from the reactor is possible without difficulty, for instance by means of a hydrocyclone.

The process of the invention can be carrried out in a semi-continuous or also in a continuous operation insofar as the throughput of the solid carbon-containing material is concerned.

In case of a semi-continuous operation the reactor is charged batchwise with hydrogen donor-solvents and granular carbon-containing material. It is preferred to mix these two materials prior to introduction into the extractor resulting in formation of a suspension and to preheat the suspension as mentioned above. The solid carbon-containing particles are then extracted during a period corresponding to the desired degree of extraction by means of a generally upwards directed current of solvent which must be at the extraction temperature. After discontinuing the hot solvent current the residual particles as well as the residual extract-lean and preferably extract-free solvent which remained in the extraction reactor are then removed whereupon the process can again start from the beginning.

In this case it is preferable to use several reactors which can be supplied successively by a single feeding device which will permit carrying out the process in a semi-continuous manner.

In case of a continuous operation, the suspension, which may have been preheated, is continuously introduced into the extraction reactor through which additional solvent is directed. The withdrawal of treated solids can then be effected at a suitable place at the end of the extraction zone of the reactor.

The extract-solvent mixture is cooled after withdrawal from the reactor. This in itself will cause part of the extract to come out of the mixture. The remaining solvent can be driven off in conventional form.

The extract can then be further processed as desired while the solvent may be regenerated, for instance in a hydrogenation step. Spent solvent which may also form part of the extract must be replenished prior to preheating and recycling into the reactor or into the mixing chamber for forming of the suspension. If desired and as already mentioned, a suitable portion of extract may be also added at this place.

Since the described extraction is an exothermic reaction the generated heat, for instance in case of a high temperature reactor, may be put to further use by way of a combination with other heat apparatus which require still higher temperature levels, such as for instance coal gasifiers. This would result in a desirable energy use.

In case of the use of a multiple stage extraction reactor which is provided with several solvent circuits it is possible to effect both the feeding of the solid carbon-containing material and the withdrawal of the treated solid material and the moving of the solid materials from one stage to the other in a continuous operation. Through this type of reactor the individual solid fractions can be treated individually and it is thus possible to obtain further improvements regarding the disintegration degree and the time of extraction. It is furthermore possible in this manner to substantially reduce the amount of solvent which moves in the circuit and is recycled. This has a cost reducing effect also regarding the performance of the pumps and the throughput performance in the separation and reprocessing stages.

The solvent throughput can further be reduced by employing, as fluidizing medium exclusively or in addition to the solvent current, an inert gas to which hydrogen may be added. The rehydrogenation of the solvent can be effected already in the extraction reactor if hydrogen is added in this manner and a hydrogen donor solvent is used. Depending on the pressure, temperature and throughput of hydrogen it is possible to obtain a more or less effective hydrogenation also of the solid carbon-containing material or of the extract. In case of use of such three-phase fluidizing bed a special gas preparation is of course necessary. The process of the invention furthermore permits also a continuous mere extractive pretreatment of the solid carbon-containing material in order to modify its technological properties, for instance its coking quality. For this purpose the suspension is introduced in a continuous manner into the extraction reactor, preferably at a pressure of 25 to 60 bar, and the parameters of the process are adjusted so that the extraction duration corresponds to the desired degree of extraction. For this purpose it is particularly useful to employ an apparatus as will be described below where the suspension is introduced in the upper portion of the extractor while the hot hydrogen donor-solvent is introduced at the lower end of the extraction zone and the carbon-containing particles will gradually sink down in the upwards directed solvent current in a fluidizing movement and will be removed from the reactor after passing through the entire reaction zone at the lower end thereof while the solvent and extraction mixture is withdrawn at the upper end.

On the other hand for the complete extraction it is advisable to employ an apparatus as also described below where the suspension is introduced at the lower end of the extraction reactor and the solvent is likewise introduced at the lower end and will cause the carbon-containing particles to move upwards during the fluidizing movement to be withdrawn, after passing through the extraction zone, through a lateral channel while the main part of the solvent-extract mixture is withdrawn in the upper portion of the extraction zone where a reduction of the current velocity takes place.

The extraction time can be varied by appropriate adjustment of the current velocity for the solvent or in case of a three-phase system of the velocity also of the gas or gas mixture and by the lay-out of the reactor. This will determine, in connection with the reaction temperature, the disintegration degree of the solid carbon-containing material. In case of pretreatments as described this degree may be below 15%. In this manner the high coking properties of a particular coal which would be undesirable for certain gasifying processes can be quickly reduced. Such pretreatment is also possible prior to other processing steps.

In summary, the advantages of the process of the invention are the following:

(1) The complete extraction of all soluble components of solid carbon-containing material, that is of the exinite and vitrinite in case of coal, the components of low solubility, particularly inertinite, still being soluble in pyridine up to 40%;

(2) the integrated solid-extract separation;

(3) the substantially continuous operation of the extraction reactor;

(4) the comparatively short extraction time which with a small loss of disintegration degree can still be shortened further;

(5) the integrated hydrogenation of the solvent in case of addition of hydrogen to the gaseous fluidizing medium and the additional hydrogenation of the carbon-containing material;

(6) the possibility of generating cheap heat as in case of the high temperature reactor which can then further be used in other processes, and finally (7) the possibility of modifying in a simple and rapid manner specific technological properties of the carbon-containing material.

BRIEF DESCRIPTION OF THE DRAWING

The three Figures of the drawing illustrate in diagrammatic manner three different embodiments of apparatus for carrying out the process of the invention.

The apparatus of FIG. 1 is adapted for a discontinuous or semi-continuous operation. The apparatus of FIGS. 2 and 3 are suited for a continuous operation.

PROCESS EXAMPLES

Figures 1, 2, 3:
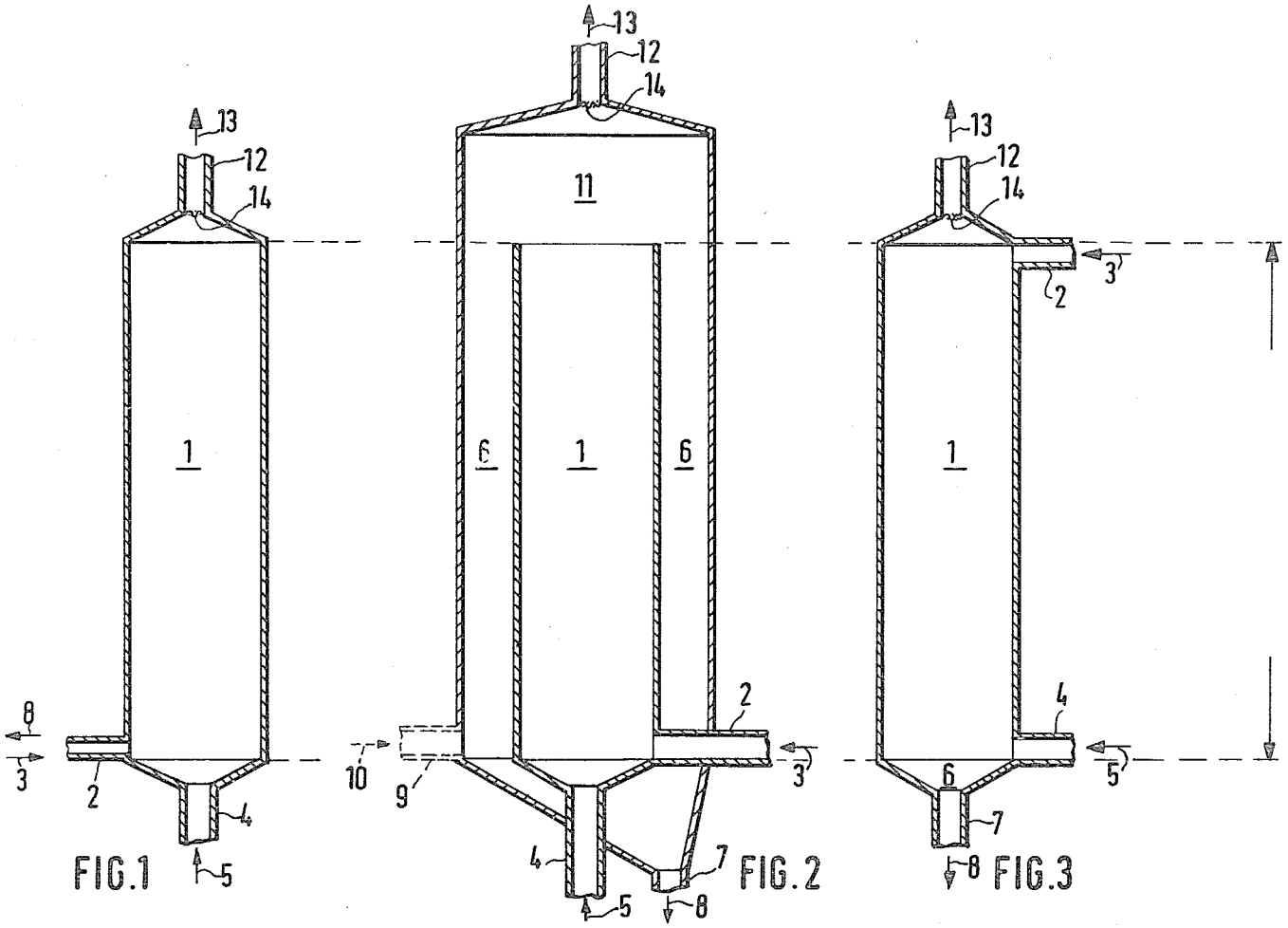

The process of the invention can be further illustrated by means of the following examples.

In these examples the different kinds of coals employed are identified further in the here following table. In all of these examples the extraction reactor was designed as further defined in claim 1 for a semi-continuous process. The reactor was constituted by a simple tube reactor of a length of about 800 mm and an interior width of 18 mm. The formation of the suspension was effected outside of the extractor while the preheating for practical reasons was effected inside the reactor.

It has, however, been found that the reactor of FIGS. 2 and 3 below can also be used in a continuous process as defined in some of the claims below. Likewise, it was found that also other hydrogen donor solvents and recyled extract components may be used.

TABLE

| | Mine where coal originated | | | |
|---|---|---|---|---|
| Contents in wt.-% | Ensdorf | Chriemhild | Johann | K 15 |
| Water | 2.8 | 2.7 | 2.7 | 2.8 |
| Ash | 3.0 | 3.1 | 3.6 | 5.77 |
| Volatiles | 39.6 | 37.7 | 27.1 | 23.8 |
| C | 83.2 | 83.8 | 88.3 | 88.52 |
| H | 5.42 | 5.38 | 4.21 | 4.89 |
| N | 2.1 | 1.61 | 1.58 | 3.92 |
| O | 7.9 | 7.8 | 4.3 | 1.63 |
| S | 0.91 | 1.09 | 1.33 | 1.04 |
| Softening-Temp. K. | 628 | 653 | 639 | |
| Vitrinite Vol.-% | 83 | 72 | 82 | |
| Exinite | 11 | 16 | 5 | |
| Inertinite | 5 | 11 | 11 | |
| Minerals | 1 | 1 | 2 | |

EXAMPLE 1

The coal originating in the Ensdorf mine with an initial grain diameter of 2.75 mm was preheated in the vertically extending reactor of FIG. 1 to about 370 K. and was then extracted at a pressure of 43 bar with hot tetralin having a temperature of 677 K. for an hour in a fluidization column. The solvent throughput was 3.6 l/h. The disintegration degree of the water and ash-free coal was about 88%.

EXAMPLE 2

The coal originating in the Chriemhild mine of an initial grain diameter of 1 mm was treated as in Example 1 at a pressure of 45 bar with tetralin of a temperature of 687 K. The solvent throughput was 9.2 l/h. The disintegration degree was about 89%.

EXAMPLE 3

The coal originating in the Johann mine of an initial grain diameter of 1 mm was treated as in Example 1 at a pressure of 45 bar with tetralin of 693 K. temperature. The solvent throughput was 9.2 l/h. The disintegration degree after 1 hour was about 91%.

EXAMPLE 4

Four times the amount of coal from the mine Ensdorf as against Example 1 with an initial grain diameter of 1 mm was treated in the same manner at a pressure of 50 bar with tetralin of a temperature of 688 K. The solvent throughput was 6 l/h. The disintegration degree after 1 hour was about 89%.

EXAMPLE 5

Coal originating from the mine K 15 with an initial grain diameter of 1 mm was treated in the same manner as in Example 1 at a pressure of 50 bar with tetralin having a temperature of 700 K. The solvent throughput was 6 l/h. The disintegration degree after 1 hour was about 80%.

EXAMPLE 6

This examples illustrates a short time extraction. Coal from the Johann mine with an initial grain diameter of 0.7 to 1.2 mm was rinsed in the flow reactor at a pressure of about 40 bar for about 5 minutes with tetralin of a temperature of 643 K. During this operation about 15% of the initial coal were put in solution. The coking properties of the initial coal were considerably diminished thereby. The swelling index decreased from 8.5 to 1–1.5. The coal did not show any longer dilation in a dilatometer.

APPARATUS

With particular reference to FIG. 1 it will be seen that the vertical extractor 1 is provided with an inlet opening 2 for a suspension of coal in the solvent, the suspension indicated by the reference number 3. This suspension inlet is disposed in the lower portion of the extractor column. At the very bottom end of the extractor there is an inlet 4 for fresh substantially extract-free solvent 5. At the top end there is an outlet 12 for the solvent-extract mixture 13. At the inner end of the outlet there is provided a screen 14 to hold back excess solids.

In this and the other figures the dashed lines indicate the extent of the real extraction zone. After completion the inlet 2 also serves a solids outlet 8.

With reference now to FIG. 2 this is an apparatus suited for continuous operation. This apparatus again has an inlet opening 2 for a suspension 3 at the lower portion of the extractor 1 and a bottom inlet 4 for fresh solvent 5. As will be seen there is a jacket 6 provided at the inside of the reactor which forms an inner channel leading from the top to the bottom. The extractor itself has an extension at the top end which has a cross-sectionally enlarged diameter 11. The extension thus has a width of about the extractor 1 plus the peripheral channel 6. An outlet 12 is again provided at the top end of the extractor for the discharge of the extract-solvent mixture 13 and the lower end of this discharge outlet is again closed by a screen 14. As distinguished from the embodiment in FIG. 1 there is provided a separate channel 7 for the residual solids 8. This channel is connected to the lower end of the peripheral channel 6 while the upper end of the peripheral channel is open towards the extension 11 of the extractor 1. A further inlet 9 is provided for substantially extract-free solvent. With reference now to FIG. 3 this also is an apparatus suited for continuous operation. There is again an extractor 1 which has an inlet 4 at its lower portion for fresh, practically extract-free solvent 5. However, the suspension of coal and solvent in this case is introduced through a channel 2 provided at the upper end of the extractor. The suspension is indicated by the reference number 3 as in the other figures. The extractor is provided with a bottom outlet 7 for the residual solids 8. This outlet is in contact with the zone 6 forming part of the extractor 1. At the top of the extractor there is again a channel 12 for the extract-solvent mixture 13. A screen 14 is again provided at the bottom end of the outlet channel.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A process for solvent extraction of a solid, particulate carbonaceous material, principally coal, comprising

[a] introducing a hydrogen donor-solvent and the carbonaceous particulate material into a generally vertically directed extraction zone;

[b] imparting a continuous generally upwards directed flow to said solvent, the solvent being at a temperature above the softening temperature of said particles and the pressure being higher than the vapor pressure of the solvent at said temperature, the flow velocity of the solvent being sufficient to cause fluidization of said particles;

[c] withdrawing the solvent together with the formed extract continuously at the top of the extraction zone while preventing the entrainment of solid particles;

[d] effecting the separation of the extract and solvent outside said extraction zone;

[e] removing the remaining solid particles together with residual extract-free or extract-lean solvent from the extraction zone separately from the withdrawal at [c]; and

[f] separating the solvent removed at [e] from the solid particles.

2. The process of claim 1 wherein a gaseous inert fluidization medium is added to the solvent to obtain said fluidization.

3. The process of claim 2 wherein hydrogen is added to the inert fluidization medium.

4. The process of claim 1 wherein the extraction of the carbonaceous particles is discontinued as soon as the particles withdrawn from the reactor exhibit the desired degree of extraction.

5. The process of claim 1 wherein the solvent after separation from the extract is rehydrogenated and then recycled into the reaction zone.

6. The process of claim 1 wherein additional fresh, substantially extract-free solvent is added during the reaction.

7. The process of claim 1 wherein the particulate carbonaceous material is introduced into the reaction zone in a preformed suspension in at least part of the hydrogen donor-solvent.

8. The process of claim 7 wherein the suspension is preheated prior to introduction into the extraction zone to a temperature short of that temperature where a substantial extraction and swelling of the carbonaceous material would occur.

9. The process of claim 8 wherein the preheating temperature for the suspension is at most 300° C.

10. The process of claim 7 wherein the suspension is introduced into the reaction zone at a pressure of 25 to 60 bar.

11. The process of claim 7 wherein the fluidization and extraction is effected in several stages and wherein in each case a separate introduction of solvent and a separate withdrawal of solvent-extract mixture is effected.

12. The process of claim 7 wherein the suspension and hot solvent are introduced into the lower portion of the extractor and the particles after passing upwards in said fluidization movement and completion of said extraction are withdrawn through a peripheral channel of the reactor while the predominant portion of the solvent-extract mixture is withdrawn through a separate outlet at the top of the extractor and above the top end of said channel, the flow velocity of the solvent extract mixture being substantially reduced while passing through said top outlet.

13. The process of claim 7 wherein the suspension is introduced in the upper portion of the reactor and hot solvent is introduced into the lower portion of the reactor and the particles sink downwards in a fluidized movement through the generally upwards directed flow current of the hot solvent and after passing through the reaction zone are withdrawn through an outlet below the inlet for the solvent or solvent-hydrogen mixture while the solvent-extract mixture is withdrawn at the upper portion of the reactor.

* * * * *